US005240364A

United States Patent [19]

Pazzaglia

[11] Patent Number: 5,240,364

[45] Date of Patent: Aug. 31, 1993

[54] LID MAGAZINE FOR AUTOMATIC CAN MANUFACTURING MACHINES

[75] Inventor: Luigi Pazzaglia, Bologna, Italy

[73] Assignee: Cefin S.p.A., Bologna, Italy

[21] Appl. No.: 882,868

[22] Filed: May 14, 1992

[30] Foreign Application Priority Data

May 22, 1991 [IT] Italy ..... B091 A 000170

[51] Int. Cl.[5] ..... B21D 51/26

[52] U.S. Cl. ..... 413/48

[58] Field of Search ..... 413/45, 46, 47, 48, 413/49, 50, 51, 52; 221/6

[56] References Cited

U.S. PATENT DOCUMENTS

| | | | |
|---|---|---|---|
| 1,967,254 | 7/1934 | Murch | 413/50 |
| 2,297,847 | 10/1942 | Wilckens | 413/47 |
| 2,385,521 | 9/1945 | Mead | 413/45 |
| 2,539,652 | 1/1951 | Amberg | 413/47 |
| 2,609,779 | 9/1952 | Goldsworthy | 413/47 |
| 2,719,528 | 10/1955 | Gabrielsen | 221/6 |

*Primary Examiner*—Bruce M. Kisliuk
*Assistant Examiner*—Jack Lavinder
*Attorney, Agent, or Firm*—Banner, Birch, McKie & Beckett

[57] ABSTRACT

The cylindrical bottom end of the magazine is embodied in two distinct sections, upper and lower, which remain united during operation; the upper section is rigidly associated with the main body of the magazine, whilst the lower section is anchored permanently on one side to the frame of the machine by way of a sliding and hinged bracket that can be retracted sideways from a first limit position, in which the two sections are stably and coaxially aligned, to a second limit position in which the lower section is distanced from the upper section to a point where it can be rotated clear.

8 Claims, 1 Drawing Sheet

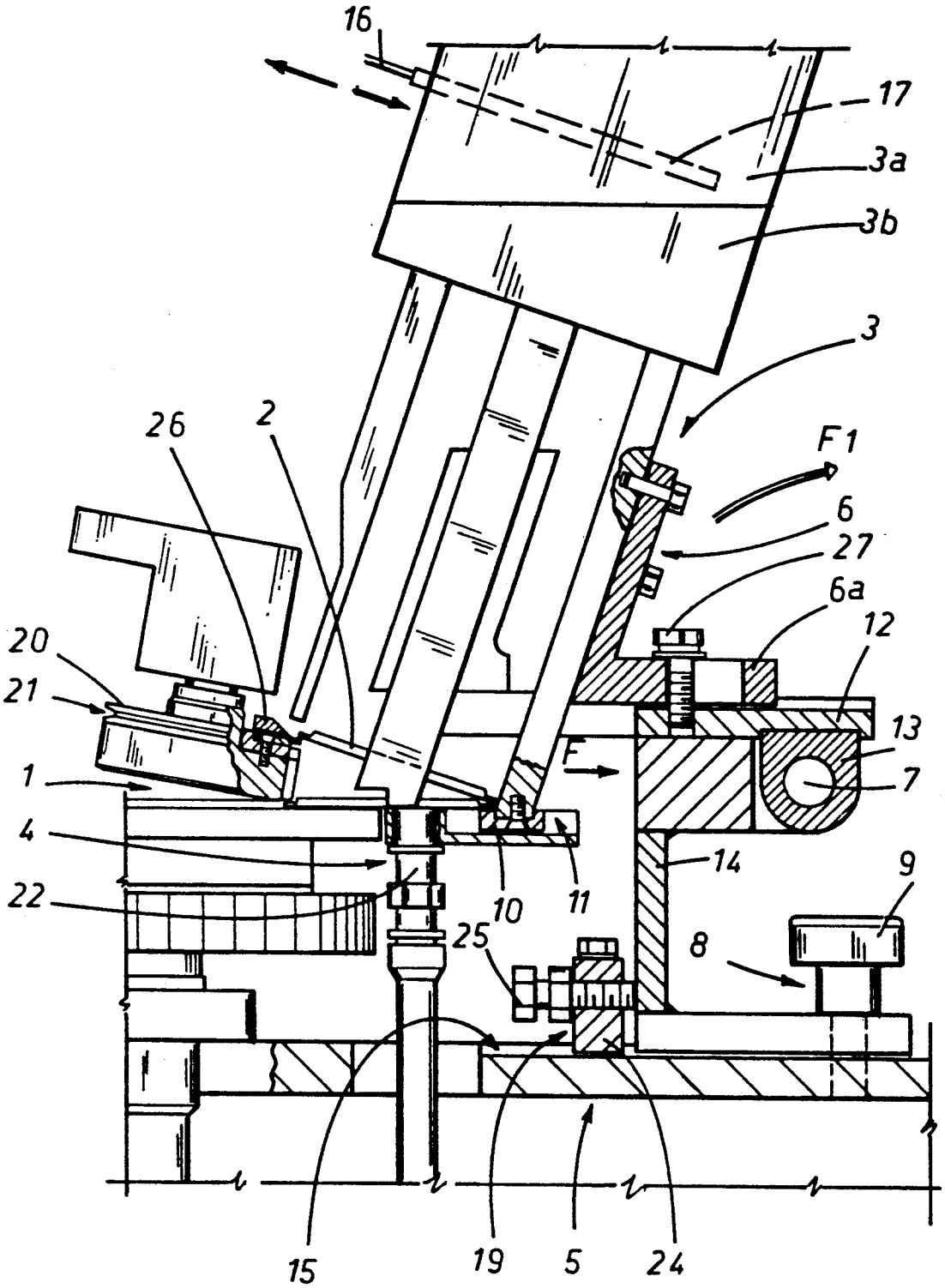
16
17
3a
3b
3
26
2
F1
6
27
6a
12
20
21
13
1
F
7
4
14
9
22
10
11
25
8
15
19
5
24

LID MAGAZINE FOR AUTOMATIC CAN MANUFACTURING MACHINES

BACKGROUND OF THE INVENTION

The present invention relates to a feed magazine of part-movable design suitable for automatic machines used in the manufacture of cans comprising a body of cylindrical (or other) geometry and two disks, one at either end of the body, constituting the lid and base of the can. The function of the magazine in question is to dispense the disks to the machine singly and in succession.

The prior art embraces lid magazines for automatic machines of the type mentioned above, consisting in a cylinder disposed preferably with the axis of its endmost part angled from the vertical, internally of which the lids (or bases) are stacked one on top of another and restrained by a retractable blade; the lids are released individually by the blade and taken up by a device comprising a circular wheel, likewise disposed preferably with its axis angled from the vertical, which affords a peripheral cam profile contoured such that each successive lid can be eased down onto a horizontal surface coinciding with a transfer station; from here, the lids are conveyed simultaneously with respective can bodies to a successive assembly and seam-folding station.

The upright cylinder of the magazine, which lies almost entirely outside the compass of the machine and may be rectilinear or otherwise, is anchored rigidly to a bracket associated with the machine, in a position facing the device by which the lids (or bases) are released. The dispensing end of the magazine comprises a set of guide bars (preferably four) adjustable for position in a radial direction so as to accommodate different sizes of lids, or bases, and creating what is effectively a channel affording access to the machine. A sensor installed at the dispensing end of the magazine, immediately below the surface onto which the single lids are lowered, serves to verify the presence or absence of the lids, and, in the event that a lid is either missing or incorrectly positioned, to inhibit the operation of the machine or suspend the flow of can bodies to the seam-folding station.

Such magazines nonetheless betray certain drawbacks deriving from the conventional type of embodiment adopted, that is to say, from the fact that all the component parts of the terminal dispensing section are permanently associated with the fixed structure of the machine, i.e. rigidly connected by means of bolts or other mechanical fasteners which are not readily disassembled. However, given that automatic machines of the type in question are operated at a particularly high production tempo (hence with a notably high throughput of lids), there is a much increased risk that two or more lids might become jammed at the dispensing end of the magazine, with the result that successive lids will buckle and the entire machine is brought to a standstill.

To remove the obstruction, the operator must first insert a rod transversely into and across the end of the magazine in order to prevent any remaining lids from descending further, and then proceed to dismantle all such components of the magazine as are associated with the machine. Needless to say, such an operation requires considerable time to effect (time wasted, in terms of production) and its impact is clearly unacceptable in the context of the operating speeds for which machines of this description are intended, and the levels of output typically expected.

Accordingly, the object of the present invention is to overcome the drawbacks in question by providing a magazine for can lids/bases of which one section is retractable and rotatable, so as to allow swift and secure maintenance and adjustment.

SUMMARY OF THE INVENTION

The stated object is realized, according to the invention, in a magazine of which the lower end is positioned over an escapement station and embodied in two distinct sections united in a plane disposed obliquely to the longitudinal axis of the magazine; the section uppermost is rigidly associated with the remainder of the magazine, whilst the lower section is associated permanently with a lateral bracket anchored to a fixed mounting and capable of translatory and rotary motion to one side of the machine between a first limit position in which the lower section is united coaxially with the upper section, and a second limit position in which the lower section is distanced from the upper section, retracted and rotated in such a way as to afford ease of access to the escapement station in the event of any irregularity, such as a jam, affecting the passage of the lids from the magazine.

BRIEF DESCRIPTION OF THE DRAWINGS

A preferred embodiment of the invention will now be described in detail by way of example with the aid of the single accompanying drawing, which is a side elevation with certain details cut away better to reveal others, showing the magazine fitted to a can manufacturing machine and positioned for operation.

DESCRIPTION OF THE PREFERRED EMBODIMENTS

A lid magazine as illustrated in the accompanying drawing is designed for use in conjunction with automatic can manufacturing machines comprising, amongst other features, an escapement station 1 at which lids or bases 2 (referred to throughout as lids for the sake of simplicity) are released from a magazine 3 and positioned singly for transfer to a further station for seam-folding to respective can bodies. The station 1 in question consists in a wheel 20 affording a peripheral cam profile 21, by means of which the lid 2 is eased from an angled position to a horizontal position in readiness for subsequent transfer to a seam-folding station (not illustrated) and assembly with a respective can body (also not illustrated, being conventional in embodiment and incidental to the disclosure).

The escapement and positioning station 1 further comprises sensing means 4 which, in the event that a lid 2 should fail to emerge from the magazine 3, will proceed to halt the flow of can bodies to the machine or to inhibit the operation of the machine; in the example illustrated, such means 4 consist in a proximity transducer 22 positioned immediately below the point at which the lids descend from the magazine 3 and wired into the electrical/electronic system of the machine (conventional, and therefore not illustrated).

The lower cylindrical end of the magazine 3 will be seen to comprise two sections **3*a* and 3*b* united in an oblique cross sectional plane with no break in continuity; the section 3*a* uppermost is associated rigidly with the remainder of the magazine 3 and extends beyond the compass of the machine, whereas the lower section 3*b* is anchored permanently on one side to a mounting 5** forming part of the main frame of the machine, by way of a bracket 6 capable of translatory motion between two limit positions: an operative position in which the lower section 3b is united coaxially with the upper section 3a, and a non-operative position in which the selfsame lower section 3b is distanced from the upper section 3a in such a manner as to afford swift access to the escapement station 1.

More exactly, the bracket 6 exhibits an essentially 'L' shaped profile of which the bottom 6a member is anchored stably by means of bolts 27 to a plate 12 affording a hinge 13 pivotably associated with a sliding carriage 14 supported on horizontal ways 15 afforded by the mounting 5, thus providing means by which to bring about the aforementioned translatory motion of the lower section 3b of the magazine 3. The lower section 3b is also associated at the end nearest the transducer 22 with a shoe 10, slidably engaged in a corresponding slot 11 afforded by the mounting 5, which operates in conjunction with a retractable blade 26 to restrain the lids 2 in the magazine 3. Successive retractions of the blade 26, for example by means of a pneumatic or electrical control (not illustrated in the drawing) permit of releasing the lids 2 one by one.

7 denotes the pivot interconnecting the plate 12 and the mounting 5, which is positioned such that the lower section 3b of the magazine can be rotated clear when in the non-operative limit position, and 8 denotes releasable locking means interconnecting the carriage 14 and the mounting 5, by which the plate 12 and the bracket 6 can be anchored stably to the mounting when occupying the operative limit position. Such means 8 appear as a set of manually operated knobs 9 with screw shanks passing through the carriage 14 and the mounting 5.

The magazine 3 also incorporates locking means 16 (electric or pneumatic) designed to prevent the descent of the lids 2, which comprises a rod 17 disposed transversely to the passage of the lids 2 and insertable into and across the upper section 3a of the magazine 3 through the agency of electric or pneumatic actuator means (e.g. a solenoid valve or a cylinder) at any given moment in which the need arises to interrupt the supply of lids 2 to the machine. Such is the case, for example, when lids 2 must be prevented from descending beyond the upper section 3a to allow the distancing movement of the lower section 3b.

19 denotes adjustable travel limiting means fitted to the mounting 5 and engaging the carriage 14, the purpose of which is to establish the aforementioned operative limit position of the bracket 6; in the example illustrated, such means 19 comprise a fixed vertical stop 24, and associated with the stop, a bolt 25 positioned facing the carriage 14 in such a manner as to occasion its arrest in the operative limit position. Besides allowing adjustment, the travel limiting means 19 will also be repositioned according to the size of the lid currently in use, hence to the internal setting of the magazine 3. Operation of the magazine will now be described. For a regular flow of lids 2 to be dispensed from the magazine 3, the two final sections 3a and 3b must be united coaxially as one to enable a normal passage of the lids to the escapement station 1. In the event that the lids 2 should jam, a signal generated by the transducer 22 will either pilot an interruption in the supply of the can bodies to the seam-folding station, or inhibit the operation of the machine altogether.

At this juncture, the operator need only loosen the knobs 9 by which the bracket 6 and the plate 12 are clamped to the mounting 5, and proceed to draw the lower section 3b away from the upper section 3a in the direction denoted F; the locking means 16 will have been activated meanwhile to prevent further descent of the lids 2 and preclude the risk of a spill. Now distanced from the escapement station 1, the lower section 3b can now be rotated upward in the direction denoted F1 about the hinge pivot 7 of the plate 12, and removed altogether if necessary by loosening the bolts 27 of the bracket, in order to enable a thorough-going inspection both of the magazine 3 and of the station 1.

With the obstruction cleared, the flow of lids 2 can be fully restored; accordingly, the operator simply returns the lower section 3b to the upright position and moves the entire sliding assembly of components 3b, 6, 12, 14 forward into its position of alignment with the remainder of the magazine 3, as established by the limiter 19, whereupon normal operation of the machine can be resumed.

The magazine disclosed thus requires a minimum of maintenance, which in any case is swiftly effected, and no internal running adjustments whatever, with the advantage that a notable reduction is achieved in down times for the automatic machine as a whole. Also, the positioning of other stations remains substantially unaffected by the architecture of the magazine, which therefore finds ready application across a variety of machine types.

What is claimed is:

1. A storage and transfer system for supplying lids or bases to a seam folding station of an automatic can manufacturing machine comprising a magazine having an upper portion and a dispensing bottom end at least one escapement station by which the lids or bases are released singly from the magazine and positioned to be transferred to said seam-folding station, and sensing means associated with the escapement station, by which the operation of the automatic machine is inhibited in the event of a lid or base failing to emerge from the magazine, wherein at least the dispensing bottom end of the magazine facing the escapement station includes upper and lower distinct sections which are in continuous alignment with each other during the release of the lids or bases, said upper section is associated rigidly with the upper portion of the magazine, and said lower section is associated permanently at least on one side with a mounting provided by the machine, by way of an interconnecting bracket capable of movement at least in a lateral direction between a first limit position in which the lower section is united coaxially with the upper section and the bracket and the mounting can be secured to each other be releasable interconnecting locking means, and a second limit position in which the lower section is spaced from the upper section, for use in the event of a lid or base failing to emerge at the escapement station.

2. A magazine as in claim 1, wherein the bracket is pivotably associated with and rotatable in relation to a carriage which is slidably supported by the mounting in such a manner that the carriage, the bracket and the lower section are capable as a unit of translatory motion in a horizontal direction toward and away from the escapement station.

3. A magazine as in claim 1, wherein the releasable locking means comprise manually operated knobs with respective screw shanks which are inserted through, and couple the bracket to the mounting.

4. A magazine as in claim 1, wherein the upper section and the lower section are united one with the other in a cross sectional plane disposed at an oblique angle to the longitudinal axis of the magazine, thereby enabling movement of the lower section at least in the lateral direction.

5. A magazine as in claim 1, wherein the lower section comprises an end adjacent to the sensing means, said end is associated on one side with a shoe slidably seated in a slot afforded by the mounting, and on the opposite side with a wheel affording a frontal cam profile positioned to interact with the lids or bases.

6. A magazine as in claim 1, wherein the bracket is substantially L-shaped having a leg member and a base member and being anchored rigidly by way of the base member to a plate affording a hinge pivotably anchored to a sliding carriage supported by horizontal ways afforded by the mounting, whereby the lower section of the magazine is rendered capable of translatory motion.

7. A magazine as in claim 6, wherein the mounting includes adjustable travel limiting means which interact with the carriage to establish an operative limit position of the carriage to be used during the release of the lids or bases.

8. A magazine as in claim 1, further comprising means to prevent the descent of the lids or bases, said prevention means comprising a rod disposed transversely to and associated with the upper section, said prevention means is operated by an electrically or fluid powered actuator in such a way as to disallow the passage of the lids or bases when the lower section is distanced from the upper section.

* * * * *